US006264122B1

(12) United States Patent
Perdreau et al.

(10) Patent No.: US 6,264,122 B1
(45) Date of Patent: Jul. 24, 2001

(54) SPA JET

(75) Inventors: Andre P. Perdreau, Northridge; Loren R. Perry, Fountain Valley; Darrin W. Swanson, Simi Valley, all of CA (US)

(73) Assignee: PACFAB, Inc., Moorpark, CA (US)

( * ) Notice: Subject to any disclaimer, the term of this patent is extended or adjusted under 35 U.S.C. 154(b) by 0 days.

(21) Appl. No.: 09/636,271

(22) Filed: Aug. 10, 2000

Related U.S. Application Data

(62) Division of application No. 09/178,404, filed on Oct. 24, 1998.

(51) Int. Cl.[7] ..... B05B 1/00; B05B 15/08; B05B 7/04

(52) U.S. Cl. ..... 239/600; 239/587.4; 239/434

(58) Field of Search ..... 239/600, 587.4, 239/434, 428.5; 4/541.1, 542.2, 541.3, 541.4, 541.5, 541.6, 492; 285/139.1, 139.2, 206, 212, 220

(56) References Cited

U.S. PATENT DOCUMENTS

| | | | | |
|---|---|---|---|---|
| 2,893,756 | * | 7/1959 | Sundstrom | 285/139.2 |
| 3,868,949 | | 3/1975 | Arneson . | |
| 4,408,721 | | 10/1983 | Cohen et al. . | |
| 4,510,967 | | 4/1985 | Spinnett . | |
| 4,800,046 | * | 1/1989 | Malek et al. | 4/541.6 |
| 4,805,664 | * | 2/1989 | Mattei et al. | 4/541.6 |
| 4,896,383 | | 1/1990 | Morgan et al. . | |
| 4,972,531 | | 11/1990 | Gravatt . | |
| 5,014,372 | * | 5/1991 | Thrasher et al. | 4/541.6 |
| 5,226,601 | | 7/1993 | Hinojosa et al. . | |
| 5,265,286 | | 11/1993 | Filipponi . | |
| 5,269,029 | | 12/1993 | Spears et al. . | |
| 5,271,561 | | 12/1993 | Tobias et al. . | |
| 5,353,447 | | 10/1994 | Gravatt . | |
| 5,657,496 | | 8/1997 | Corb et al. . | |
| 5,971,444 | * | 10/1999 | Hawkins | 285/139.2 |

FOREIGN PATENT DOCUMENTS 3820349 12/1989 (DE) .

OTHER PUBLICATIONS

Waterway 1996 Product Catalog, p. 14.
Waterway 1994 Product Catalog, pp. 2 and 10.

* cited by examiner

*Primary Examiner*—David A. Scherbel
*Assistant Examiner*—Davis Hwa
(74) *Attorney, Agent, or Firm*—Christie, Parker & Hale, LLP

(57) ABSTRACT

A spa jet comprising a first nozzle, a second nozzle, and an aeration chamber therebetween, are all disposed in a housing. One seal forms a watertight seal between the first nozzle and the housing, and another seal forms a watertight seal between the second nozzle and the housing. A ring is affixed to the second-nozzle downstream end, and a third nozzle is pivotally mounted in the ring. A retainer is mounted to the ring and it frictionally secures the third nozzle in any one of a continuum of angular positions. The ring can be a ball-bearing ring, whereby the third nozzle can freely rotate in the ball-bearing ring under the force of a water stream exiting the third nozzle. A non-circular opening in the third nozzle assists in rotating the third nozzle even when centered in the ring. A barrel, comprising the first and second nozzles and the aeration chamber, has latching tabs formed thereon, and the housing has a retaining profile formed therein for engaging the latching tabs. A scallop has slots formed therein, and the barrel has snap tabs formed thereon for releasably engaging the slots. The housing is secured to a spa wall by a nut. A compensation spacer is disposed between the nut and the spa wall to absorb spa wall irregularities.

2 Claims, 3 Drawing Sheets

SPA JET

The present application is a divisional of U.S. patent application No. 09/178,404, filed Oct. 24, 1998, and the entire disclosure of such prior application is hereby incorporated herein by reference.

FIELD OF THE INVENTION

The present invention relates generally to the field of spa jets, and, more particularly, to hydro-therapy spa jets. Although the present invention is subject to a wide range of applications, it is especially suited for use in a spa, and will be particularly described in that connection.

BACKGROUND OF THE INVENTION

Hydro-therapy is a useful form of physical therapy. In hydro-therapy, patients rest in a body of water within a spa, while their anatomy is massaged by an aerated water stream flowing out of a spa jet. The spa jet provides an aerated water stream, which is directed by a nozzle, through the body of water and against the portion of the patient's anatomy where the massaging action is desired.

To properly aerate the water stream, a high-velocity water stream is usually necessary. Unfortunately, high water-stream velocities are uncomfortable to the patient. Furthermore, when directional control of the aerated water stream is incorporated into hydro-therapy spa jets, back pressure generally results in the spa jet, causing interference with the process of aerating the water entering the spa jet. Accordingly, spa-jet designers have aimed to design hydro-therapy spa jet that produce a well-aerated stream of water that is not uncomfortably strong, and can be directionally controlled to aim the water stream at the particular part of the patient's anatomy that needs therapy.

A conventional hydro-therapy spa jet includes a first nozzle that accelerates a stream of water and feeds the water stream into an aeration chamber. The accelerated water becomes aerated in the chamber, and then passes through a second nozzle, and possibly a third nozzle, before reaching the body of water with sufficient force to create a massaging action. The result is a stream of water that is particularly therapeutic. While this design is widely used in the hydro-therapy spas, it does not lend itself to providing aerated water streams that can vary the massaging action. In particular, this design is unforgiving in terms of any changes made to the first nozzle, chamber, or second nozzle. Any changes in the chamber and nozzles can cause fluctuations in the operation of the spa jet, such as, preventing the spa jet from drawing sufficient air, which would hinder the massaging action of the water stream. Additionally, this design provides a narrow window of parameters in which to operate, and can lead to aerated water streams that are often too strong, which can become relatively uncomfortable to the patient after a short period of time.

It is also generally known that a nozzle with a spherical exterior can be mounted in a ball socket to produce a directional nozzle that may be pivoted in eyeball-like fashion to direct the aerated water stream. Such nozzles, deflect a portion of the water stream. This deflection disrupts the laminate flow of the water stream, which creates a turbulent stream that cannot be directed with precision. Furthermore, to the extent that the water is deflected, the deflection itself causes turbulence where the nozzle applies turning forces to the water stream, thus adding to the back pressure that interferes with the aeration process.

Another problem with this design is that the vacuum created in the aeration chamber can draw unwanted water, air, and debris into the spa jet, particularly into the air-inlet opening of the aeration chamber. This backflow of debris, water, and air reduces the amount of air entrained into the water stream, thus reducing the massaging action of the spa jet. Additionally, debris can interfere with the pivoting of the directional nozzle. Furthermore, if the nozzle is a rotational type that is mounted in a ball-bearing ring, the debris can clog the ball bearings and interfere with the rotation of the nozzle.

Yet another problem with traditional spa jets is water leakage through a hole cut into the wall of the spa that is used to mount the spa jet. Typically, leakage problems arise because the varying thickness of the spa wall cross section prevents the spa jet from reliably sealing against the inside of the spa wall. While sealing gaskets and sealants have traditionally been used to prevent migration of water into the porous laminates at the edge of the hole, water leakage still occurs. Additionally, the use of sealants further delays the pressure testing of the spa jet until the sealant has cured, resulting in further installation time and cost.

A further problem with traditional spa jets is the inability to change the design of the front of the fixture in which the third jet nozzle is housed. This fixture is known as a scallop. Typically, the scallop design does not vary for a particular manufacturer's spa jet. Thus, once a consumer chooses a particular spa-jet manufacturer, the consumer has no ability to customize the look of the spa jet after it is installed in the spa, other than by replacing the spa jet.

Accordingly, there exists a need for a hydro-therapy spa jet with the ability to provide a variety of aerated water streams to address varying therapeutic requirements in terms of the velocity, direction, and feel of the aerated water stream. Additionally, a need exists for a hydro-therapy spa jet which prevents unwanted debris, water, or air from being drawn into the jet and detrimentally affecting the operation of the hydro-therapy spa jet Further, there exists a need for an improved installation of the spa jet to prevent water leakage without the installation costs, including special tools, required by current methods. Finally, a need exists to allow consumers to easily customize the appearance of an installed spa jet.

SUMMARY OF THE INVENTION

The present invention provides a spa jet that is more versatile with respect to the variations in the massaging action that can be created. Additionally, this invention provides for less debris, water, and air from being drawn into the spa jet, a less leaky installation, and easily customized installed spa jets. The present invention satisfies these and other needs, and provides further related advantages.

According to the present invention, isolating the air-inlet opening to the chamber, which is between two nozzles, from the remainder of the spa jet. This can be accomplished by at-least-two seals—one seal is configured to form a water-tight seal between a first nozzle and the housing, and another seal is configured to form a watertight seal between a second nozzle and the housing. Thus, the at-least-two seals reduces the migration of debris, water, or air from being pulled towards the chamber, resulting in less fouling of the air intake into the chamber, the pivotal directional nozzle, and the ball bearings of a rotatable nozzle.

In further accordance with the present invention, directing the water stream in a continuum of directions. This can be accomplished by a pivotally mounted nozzle and a retainer that frictionally secures the nozzle in any one of the continuum of angular positions. Thus, the possible variable massaging actions is increased as there are a greater number of directions to direct the aerated water stream and infinitely fine control of the direction.

In still further accordance with the present invention, providing a massaging action even when the nozzle is not at an angular position. This can be accomplished by rotatably mounting a nozzle having a non-circular opening to a ball-bearing ring. Thus, the nozzle can freely rotate in the ball-bearing ring under the force of the water stream exiting the non-circular opening to provide a swirling massaging action.

Also in accordance with the present invention, selecting the water stream velocity. This can be accomplished by a rotatable barrel having a slot formed in the upstream end and disposed adjacent a water-inlet port of the spa jet. Rotation of the barrel adjusts the flow of the water stream into the barrel according to the amount of the slot that is adjacent to the inlet port. Thus, the massaging action can be varied according to the selection of the water stream velocity.

In further accordance with the present invention, releasably mounting the barrel to the housing. This can be accomplished by a retaining profile formed on an inner surface of the housing and at-least-two latching tabs formed on the barrel for engaging with the retaining profile. Thus, barrels can interchanged to accommodate different nozzles, such as, rotating and non-rotating types.

In still further accordance with the present invention, releasably mounting the scallop to the barrel. This can be accomplished by a scallop having at-least-two slots formed therein and a barrel having at-least-two snap tabs formed thereon for releasably engaging the at-least-two slots. Thus, any one of a plurality of scallops with the at-least-two slots can be interchanged with the spa jet. Furthermore, with interchangeable barrels, an even greater number of scallops can be interchanged, provided the tabs and slots are mateable.

Also in accordance with the present invention, accommodating for spa wall irregularities. This can be accomplished by a compensation spacer disposed between a nut that secures the housing to the spa wall. Thus, a uniform compression of a sealing gasket disposed between the spa wall and a housing flange can be achieved to provide a better seal for the spa jet.

Other features and advantages of the present invention will be set forth in part in the description which follows and accompanying drawings, wherein the preferred embodiments of the present invention are described and shown, and in part become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

DESCRIPTION OF THE PREFERRED EMBODIMENTS

Figure 1:
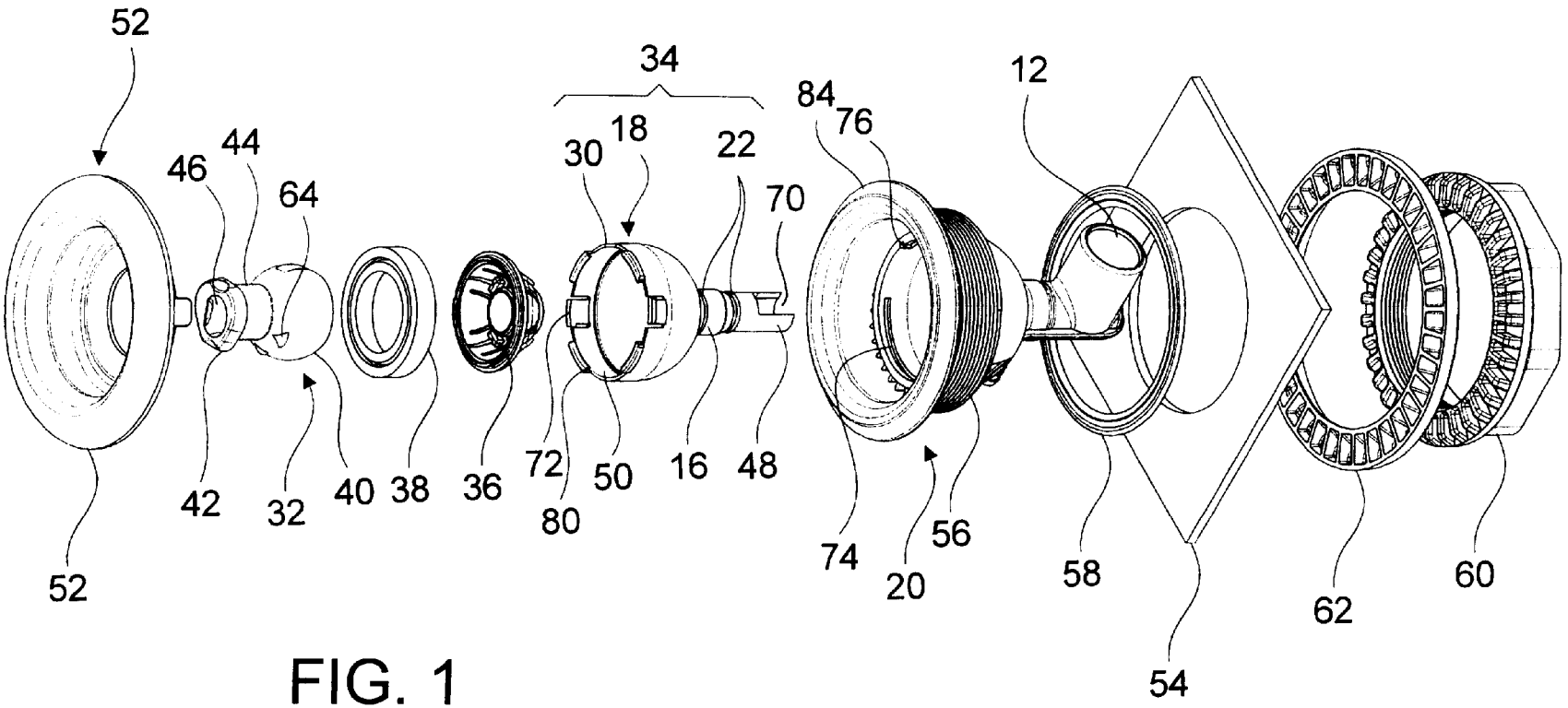
FIG. 1 is an exploded, front, perspective view of a spa jet configured according to the present invention.
Figure 2:
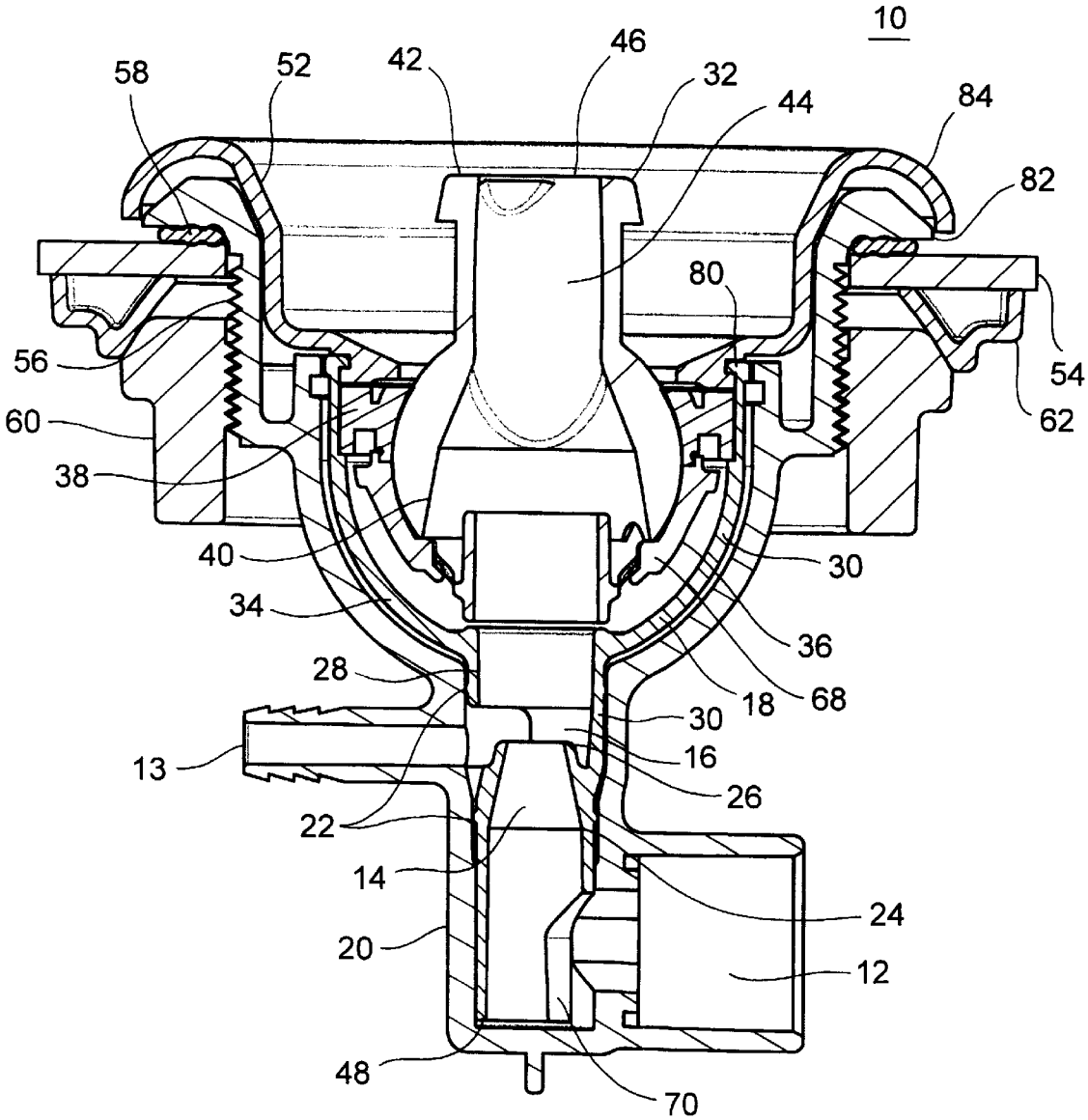
FIG. 2 is a cross-sectional side view of the assembled spa jet shown in FIG. 1.
Figure 3:
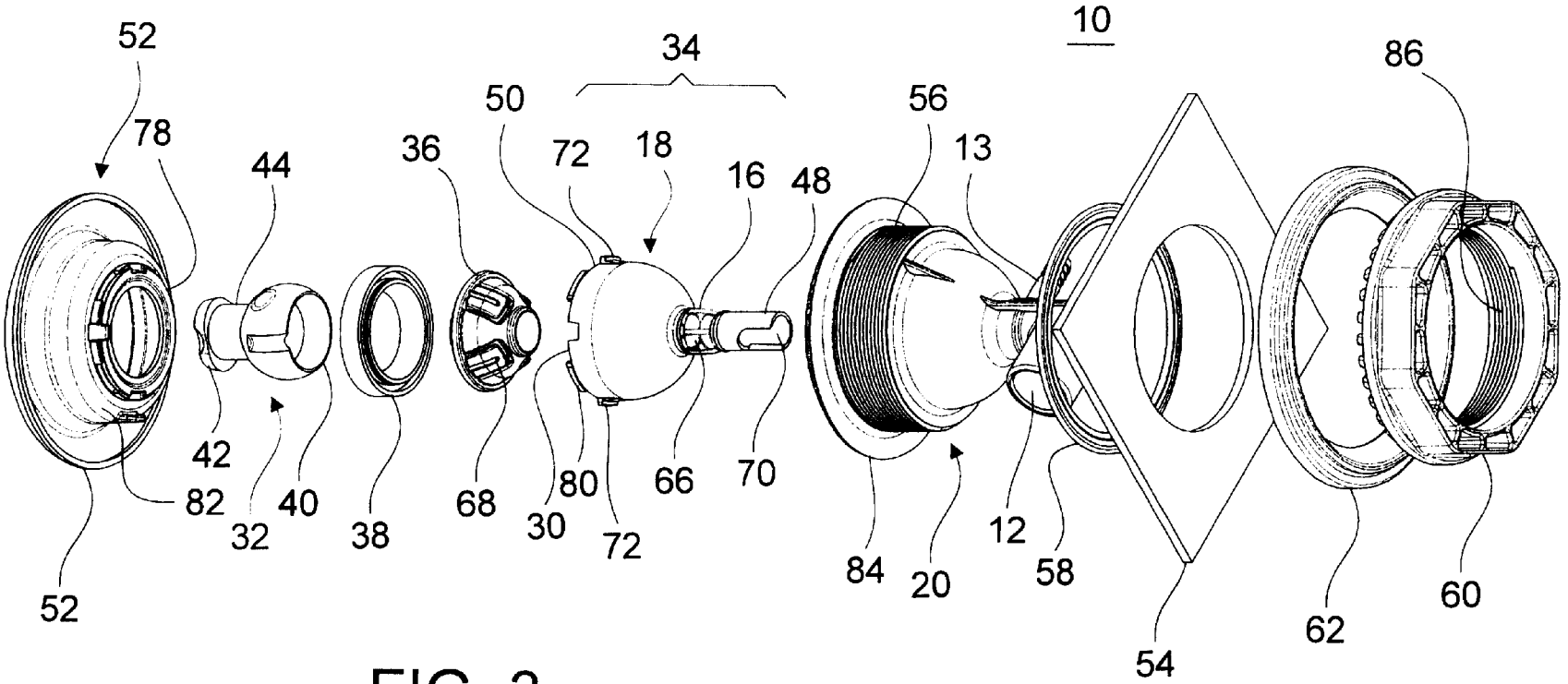
FIG. 3 is an exploded, rear, perspective view of the spa jet shown in FIG. 1

As shown in the exemplary drawings, and with reference to FIGS. 1–3, the present invention is embodied in a spa jet 10 comprising, among other things, a first nozzle 14, a chamber 16, and a second nozzle 18. All are disposed within a housing 20 of the spa jet.

The housing 20 has a water inlet port 12 and an air inlet port 13 integrally formed therethrough. Inlet port 12 admits water into the spa jet 10, and inlet port 13 admits air into the spa jet 10.

The first nozzle 14 has an upstream end 24 and a downstream end 26. The first nozzle 14 also has a conical shape with the first nozzle 14 contacting in the downstream direction. The water enters the first nozzle 14 at its upstream end 24 and is accelerated by the contracting shape of the first nozzle 14 so that the water stream exiting the first nozzle 14 at its downstream end 26 is an accelerated water stream. The accelerated water stream enters the chamber 16, creating a low pressure within the chamber 16 relative to atmosphere. Air is drawn into the chamber 16 via a chamber opening 66 by the pressure differential, and the water stream is thus entrained with the air, creating an aerated water stream.

The second nozzle 18 includes an upstream end 28 and a downstream end 30. The second nozzle 18 expands in the downstream direction to decelerate the aerated water stream which enters through the second nozzle upstream end 28 and exits through the second-nozzle downstream end 30.

Because of the pressure differential, unwanted air, water, and debris also are drawn to the chamber 16, for example, spa water, including hair and other debris in the water, and water from the water-inlet port 12. Debris can be a problem if a pivotal nozzle or rotating nozzle is employed in the spa jet, as it tends to hinder the pivoting and rotation of the nozzle. Furthermore, in order to properly aerate the water stream in the chamber 16, the chamber must be free from unwanted air, water, or debris that may enter the chamber.

In this illustrated embodiment, which is configured according to the present invention, a pair of seals 22, or more, isolate the chamber opening 66. The seals are disposed upstream and downstream of the chamber 16. One seal 22 is integrally and circumferentially formed on the first-nozzle upstream end 24 to create a watertight seal between the first-nozzle upstream end 24 and the housing 20. Another seal 22 is integrally and circumferentially formed on the second-nozzle upstream end 28 to form a watertight seal between the second-nozzle upstream end 28 and the housing 20. A particularly advantageous material for the integrally formed seals is polypropylene. A skilled artisan will recognize that the seal can be made with other materials, such as polyvinylchloride or polyethelyne, and by other means, such as, rubber O-rings.

Because the air intake of chamber 16, and the low-pressure area, are isolated, the seals reduce the migration of debris, water, or air from being pulled towards the chamber. This results in less fouling of the air intake of the chamber, and, if employed in the spa jet, less interference with the pivoting action of a directional nozzle and the rotation action of a rotatable nozzle.

Spa jet 10 further includes a third nozzle 32, a ring 38, and a retainer 36.

The third nozzle 32 has an upstream end 40, a downstream end 42, and a body 44 therebetween. The decelerated aerated water exits the second-nozzle downstream end 30 and enters the third-nozzle upstream end 40. The decelerated aerated water stream is communicated along the third-nozzle body 44 to the third-nozzle downstream end 42, where the aerated water stream exits through an opening 46 at the third nozzle downstream end 42.

Ring 38 is affixed to the second-nozzle downstream end 30. Third nozzle 32 can be pivotally mounted in the ring.

Furthermore, ring 38 can be a ball-bearing ring and thus the third nozzle can freely rotate in the ball-bearing ring under the force of the water exiting the third nozzle.

When the third-nozzle body 44 is not aligned to the water flow path, the aerated water stream from the opening 46 is diverted at an angle relative to the water flow path in the second nozzle 18. By diverting the water, force is imparted to the third nozzle 32 which causes the third nozzle 32 to rotate. The rotation speed of the third nozzle increases as the angle between the third nozzle 32 and the water flow path increases.

In this illustrated embodiment, which is configured according to the present invention, retainer 36 can be mounted to the ring adjacent the third-nozzle upstream end 40. The retainer frictionally secures the third nozzle in a continuum of angular positions relative to the direction of the water stream flowing through the second nozzle.

The retainer can include at-least-one resilient prong 68 formed therein. The at-least-one resilient prong is in contact with, and applies a force to, the third-nozzle upstream end 40 to secure the third nozzle in any one of the continuum of angular positions.

Thus, the possible variable massaging actions are increased as there are a greater number of directions to direct the aerated water stream and finer control of the direction than is found in conventional spa jets.

The spa jet 10 further comprises a detent including at-least-one external protrusion 64 formed on the third nozzle. The external protrusion abuts the ring 38 when the third nozzle is at a predetermined angular position. In the embodiment shown in FIG. 2, the predetermined angular position is when the third nozzle is centered in the ring.

In this illustrated embodiment, which is configured according to the present invention, the third-nozzle downstream end 42 has a non-circular opening 46 that assists in the rotation of the third nozzle. Even in the centered position, the third nozzle can freely rotate in the ball-bearing ring under the force of the water stream exiting the non-circular opening.

A barrel 34, which is a one-piece, integrally formed first nozzle 14, chamber 16, and second nozzle 18, has an upstream end 48 and a downstream end 50. The barrel upstream end 48 receives water from the inlet port 12 of the housing 20. The barrel 34 thus provides a water path from the water inlet port 12 to the third nozzle 32.

The barrel upstream end 48 has a slot 70 formed therein. The barrel 34 can be rotatably disposed in the housing with the upstream end 48 disposed adjacent the inlet port 12. According to the amount of the slot that is adjacent to the inlet port, or, conversely, the amount of solid barrel material that is adjacent to, and blocking, the inlet port opening; the rotation of the barrel in the housing adjusts the flow of the water stream into the barrel upstream end and, ultimately adjusts the flow of the water stream out of the jet spa 10.

In this illustrated embodiment, which is configured according to the present invention, the barrel downstream end 50 has at-least-two latching tabs 72 formed thereon, and the housing 20 has a retaining profile 74 formed therein for engaging the at-least-two latching tabs. The barrel is releasably mounted to the housing as the barrel is inserted into the housing and the at-least-two latching tabs pass the retaining profile and snap into a locking position.

The retaining profile 74 has a stop with a ramping profile 76 formed therein. Barrel 34 is removed from the housing 20 by rotating the barrel until the at-least-two latching tabs 72 abut the stop, and further rotating the barrel to compress at-least-two the latching tabs as they follow the ramping profile.

The barrel 34 can also be used to mount third nozzles that do not rotate. Thus, a user can exchange a rotating third nozzle with a non-rotating third nozzle.

In this illustrated embodiment, which is configured according to the present invention, the spa jet 10 further includes a scallop 52 releasably mounting to the barrel downstream end 50. The scallop 52 can be rotated, and the barrel 34 in turn rotates, to adjust the velocity of the aerated water stream exiting the spa jet.

The scallop 52 has at-least-two slots 78 formed on its rear upstream surface 82. The barrel 34 has at-least-two snap tabs 80 formed on third-nozzle downstream end 42 that can releasably engage the slots 78. The scallop can be disengage from an installed spa jet by removing the the barrel, as previously described, along with the attached scallop, and prying the scallop from the barrel.

All scallops with the slots that are mateable to the snap tabs can be affixed to the spa jet. Furthermore, with interchangeable barrels, an even greater number of scallops can be interchanged, provided the tabs and slots of each are compatible. Also, entire barrel and scallop combinations can be interchanged.

As shown in FIG. 2, the spa jet 10 is attached to a spa wall 54 a nut 60 engaged with housing 20.

The housing has screw threads 56 formed on an exterior surface of a sleeve of the housing. The housing further has a flange 84 extending from its downstream end. The threaded sleeve extends through the hole in the spa wall 54.

The nut 60 has an interior surface 86 having screw threads formed on it that are mateable to the housing screw threads. The housing is secured to the nut via the mating of the screw threads of the housing and the nut.

A gasket 58 is disposed between the spa wall and the housing flange to form a seal to prevent spa water from leaking out of the hole.

In this illustrated embodiment, which is configured according to the present invention, spa jet 10 further includes a compensation spacer 62. The compensation spacer 62 absorbs irregularities on the outside spa wall that would prevent a uniform compression of the sealing gasket. The compensation spacer 62 is disposed between the nut and the spa wall. Thus, the nut has a flat surface to engage when screwed onto the sleeve.

From the foregoing, it will be appreciated that the present invention represents a significant advance in the field of hydro-therapy spa jets. Although several preferred embodiments of the invention have been shown and described, it will be apparent that other adaptations and modifications can be made without departing from the spirit and scope of the invention. Accordingly, the invention is not to be limited except as by the following claims.

What is claimed is:

1. A spa jet for mounting in an opening through a spa wall having surface irregularities, the spa jet comprising:

a hollow housing extending about a central axis, said housing having an open forward end;

a flange extending outwardly from said housing around said opening, said housing adapted to be mounted in and and extending through the opening with its axis aligned with the axis of the opening and with said flange overlapping adjacent portions of one surface of the spa wall;

a compressible sealing gasket extending around said housing in contact with said flange and adapted to abut the forward surface of the spa wall;

a generally cylindrical, externally-threaded sleeve region of said housing extending at least partially through and rearwardly beyond an opposite surface of the spa wall when said housing is positioned in the opening;

an internally threaded nut engaging said sleeve region of said housing; and an annular compensation spacer encircling said sleeve region forwardly of said nut, said compensation spacer adapted to engage the opposite surface of the spa wall having radially-spaced, circumferentially-extending walls adapted to engage the spa wall, said compensation spacer shaped to enable said compensation spacer to absorb the irregularities in spa wall and thereby provide uniform compression of said sealing gasket and to be clamped thereagainst by said nut.

2. A spa jet as defined in claim 1 wherein said compensation spacer comprises, a ring-shaped member having, an outer wall adapted to contact the spa wall generally perpendicularly;

an inner wall adapted to contact the spa wall at an angle inclined rearwardly towards said outer wall; said nut bearing against said inner wall and a connecting wall extending between and joining said inner and outer walls.

* * * * *